US005289647A

United States Patent [19]

Mercer

[11] Patent Number: 5,289,647

[45] Date of Patent: Mar. 1, 1994

[54] SHOE WITH RETRACTABLE SPIKES

[76] Inventor: Donald R. Mercer, P.O. Box 367, Thomaston, Ga. 30286

[21] Appl. No.: 118,095

[22] Filed: Sep. 8, 1993

Related U.S. Application Data

[63] Continuation of Ser. No. 947,529, Sep. 21, 1992, abandoned.

[51] Int. Cl.[5] ..... A43B 5/00; A43C 15/00

[52] U.S. Cl. ..... 36/134; 36/61; 36/67 D

[58] Field of Search ..... 36/61, 134, 127, 67 R, 36/67 A, 7.6, 7.8, 67 D

[56] References Cited

U.S. PATENT DOCUMENTS

| | | | |
|---|---|---|---|
| 1,361,078 | 12/1920 | Lynn | 36/61 |
| 2,421,072 | 5/1947 | Kramer | 36/67 D |
| 2,758,396 | 8/1956 | Edwardes | 36/67 D |
| 3,267,593 | 8/1966 | Turner | 36/67 D |
| 3,566,489 | 3/1971 | Morley | 36/67 D |
| 3,716,931 | 2/1973 | Loudermilk | 36/61 |
| 3,793,751 | 2/1974 | Gordos | 36/61 |
| 4,159,582 | 7/1979 | Ostrowski | 36/134 |
| 4,205,466 | 6/1980 | Collins | 36/67 D |
| 4,226,032 | 10/1980 | Herro | 36/127 |
| 4,271,608 | 6/1981 | Tomuro | 36/61 |
| 4,375,729 | 3/1983 | Buchanen | 36/61 |
| 4,715,133 | 12/1987 | Hartjes et al. | 36/127 |
| 4,821,434 | 4/1989 | Chein | 36/134 |
| 4,825,562 | 5/1989 | Chuang | 36/61 |
| 4,873,774 | 10/1989 | Lefever | 36/61 |

FOREIGN PATENT DOCUMENTS

| | | | |
|---|---|---|---|
| 3046811 | 7/1982 | Fed. Rep. of Germany | 36/134 |
| 3644812 | 6/1988 | Fed. Rep. of Germany | 36/134 |

*Primary Examiner*—Paul T. Sewell
*Assistant Examiner*—Marie Denise Patterson
*Attorney, Agent, or Firm*—Timmons & Kelly

[57] ABSTRACT

A golf shoe has a sole and a heel attached to an upper. A spike is housed within a housing inserted into the sole or the heel. The housing includes a hollow cylinder threaded into the sole or heel. The cylinder houses a helical spring that biases a spike to the extended position. When the shoe is used on a hard surface, the surface forces the spike upward against the spring to a retracted position.

5 Claims, 2 Drawing Sheets

SHOE WITH RETRACTABLE SPIKES

This application is a continuation of application Ser. No. 07/947,529, filed Sep. 21, 1992, now abandoned.

BACKGROUND OF THE INVENTION

1. Field of the Invention

This invention relates in general to footwear. In particular, the invention relates to shoes having spikes, such as golf shoes.

2. Description of the Prior Art

Golf shoes, and some other sports shoes, have spikes in order to provide stability. The spikes extend downward into the ground to keep the feet from slipping during a golf swing. Spikes are usually about a quarter of an inch long and are made of a metal, such as steel. Usually each spike extends downward from a circular disc, which is attached to the sole or heel of the golf shoe.

Unfortunately, golfers and other athletes wearing spikes sometimes have to walk ()n surfaces other than grass. For example, golfers sometimes walk on cart paths, club shop floors, and rocky ground. Such surfaces can be uncomfortable or even dangerous to a person wearing spiked shoes, since the steel spikes cannot enter the hard surface and may slip. Another problem is that spikes may be damaging to some surfaces, such as floors and carpets. It is for this reason that spiked shoes are usually not allowed within club shops, and golfers must change or remove their shoes before entering a club shop.

In order to ease the problems with spikes, shoes have been designed with retractable spikes. These shoes usually have a mechanical or pneumatic apparatus for moving the spikes from an extended position to a retracted position.

U.S. Pat. No. 4,271,608, issued Jun. 9, 1981, to Tomuro, shows a golf shoe in which the spikes are concealed within a resilient elastic material . When the wearer of the shoe steps down on the shoe, the spikes are driven into the ground. When the foot is raised, the spikes retract, and any mud on the bottom of the shoe can be easily removed.

SUMMARY OF THE INVENTION

The general object of the invention is to provide a golf shoe that has spikes for use on a grassy surface, but which will reduce the risk of injury (turned ankles, spike bruises, etc.) associated with prior art golf shoes, and reduce potential damage to harder surfaces. This object is accomplished by a shoe having spikes that automatically retract when the wearer of the shoe steps on a hard surface. The shoe has a sole and a heel attached to an ordinary shoe upper. A housing is inserted into the sole of the shoe, and a spike extends downward from the housing. A biasing means, such as a helical spring, biases the spike downward, but allows the spike to retract into the housing if the shoe is placed on a hard surface.

The housing includes a hollow cylinder, with an integral cap on its upper end, and a circular disc on its lower end. The helical spring and part of the spike are housed within the housing. The spike extends downward through an opening in the disc. The spring can be replaced by removing the disc from the shoe.

The above, as well as additional objects, features, and advantages of the invention will become apparent in the following detailed description.

DESCRIPTION OF THE PREFERRED EMBODIMENT

Figure 1:
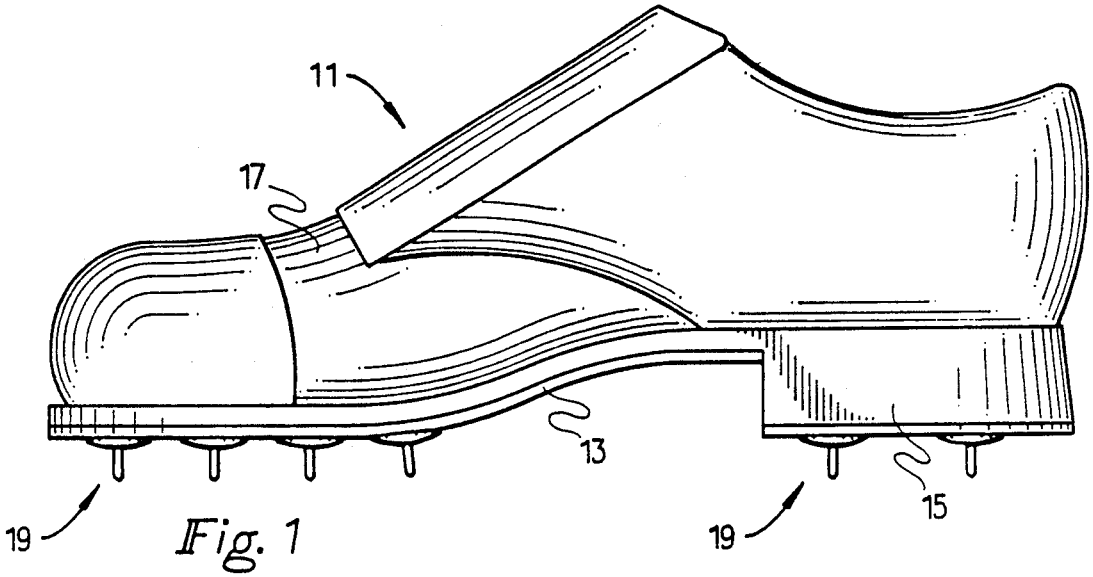
FIG. 1 is a side view of a golf shoe including the retractable spikes of the invention.

The golf shoe 11 of the invention, shown in FIG. 1, has a sole 13 and a heel 15 attached to a standard golf shoe upper 17. A typical golf shoe 11 will have about six spike assemblies 19 in the sole 13 and about four additional spike assemblies 19 in the heel 15.

Figure 2:
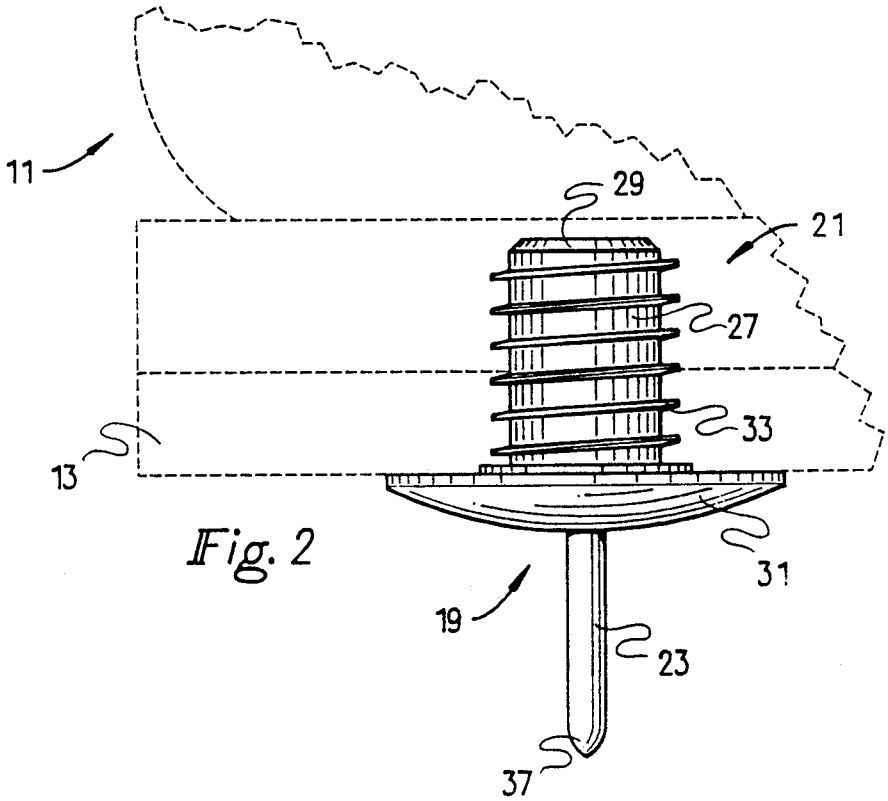
FIG. 2 is an enlarged side elevation of a single spike assembly of the invention, with a portion of the golf shoe shown in dashed lines.
Figure 3:
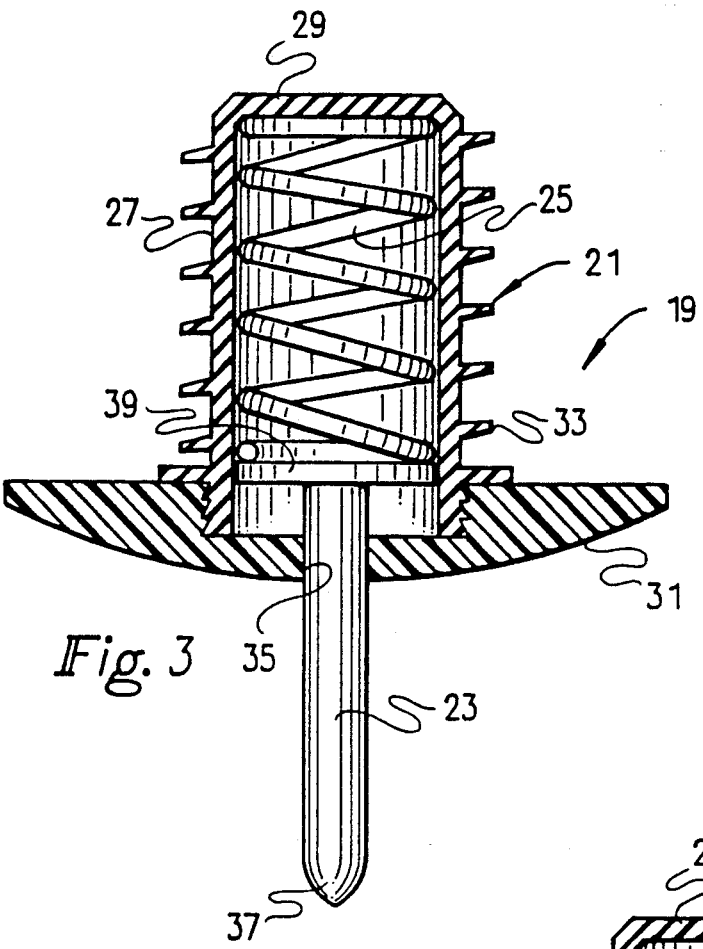
FIG. 3 is an enlarged sectional side view of one of the spike assemblies shown in FIG. 1, with the spike in the extended position.
Figure 4:
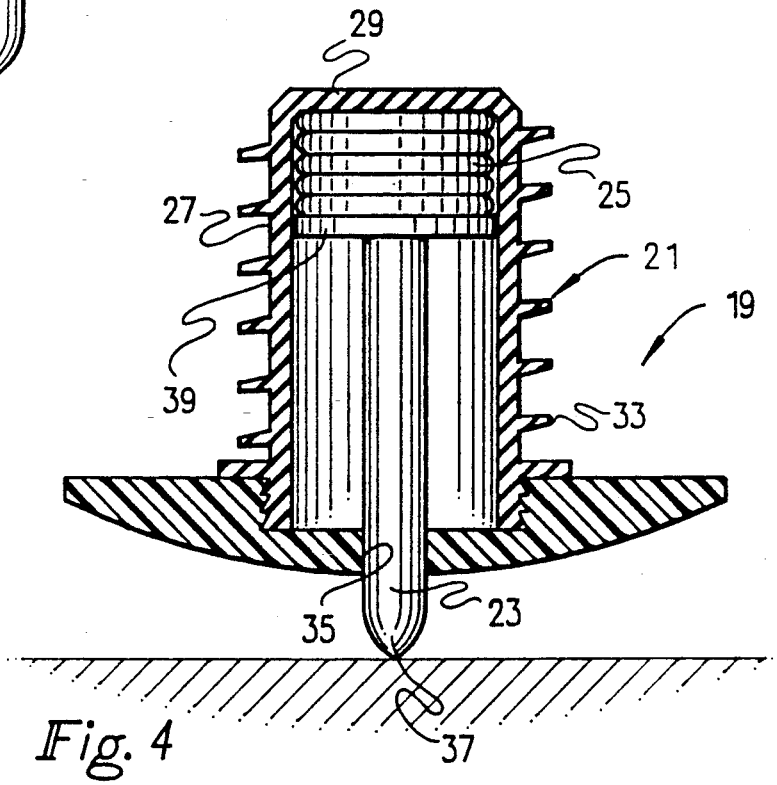
FIG. 4 is an enlarged sectional side view of one of the spike assemblies shown in FIG. 1, with the spike retracted by a hard surface.

FIGS. 2–4 illustrate a single spike assembly 19 in greater detail. Each spike assembly 19 includes a housing 21, a spike 23, and a biasing means 25. Each housing 21 is a hollow cylinder 27, with a cap 29 on one end and a disc 31 on the other end. The cylinder 27 has external threads 33, so the spike assembly 19 can be threaded into a hole drilled in the sole 13 or heel 15 of the shoe 11.

The cylinder 27 and the cap 29 are preferably integral to one another, although, alternatively, the cap 29 could be friction f i t or threaded onto the cylinder 27. The cap 29 is attached to the upper end of the housing 21 and supports one end of the biasing means 25.

The biasing means 25 is preferably a spring 25, as shown in FIGS. 3 and 4. The spring 25 is preferably a helical spring, although other types of spring may also work. The spring 25 is retained between the cap 29 and the upper end of the spike 23, and biases the spike 23 downward. If the spike 23 is forced upward against the spring 25 with sufficient force, the spring 25 allows the spike 23 to retract into the housing 21.

The disc 31 is located at the lower end of the cylinder 27, and is preferably integral with the cylinder 27. Alternatively, the disc 31 could be threaded or press fit onto the cylinder 27. The disc 31 has a small circular opening 35, through which the spike 23 extends. The opening 35 must fit snugly around the spike 23 to prevent debris from entering the cylinder 27.

The lower end 37 of the spike 23 is pointed, and the upper end has a flat base 39. The base 39 abuts the lower end of the spring 25. When a person wearing the shoe 11 steps on grass or soil, the spring 25 pushes the spike 23 downward to the extended position shown in FIGS. 2 and 3. When the wearer steps on a harder surface, the surface forces the spike 23 upward against the spring 25 to the retracted position shown in FIG. 4.

The shoes 11 of the invention have several advantages over the prior art. The shoes 11 are more comfortable than prior art golf shoes, because the spikes 19 retract whenever the wearer of the shoes 11 steps on a hard surface. The spikes 19 are less likely to damage a floor or carpet, so the wearer may not have to change or remove the shoes 11 before entering a club shop or other building. Also, the spikes can be integral to the shoes, or the spikes can be made to replace the spikes on prior art shoes.

The invention has been described in only one embodiment. it should be apparent to those skilled in the art that the invention is not so limited, but is susceptible to various changes and modifications without departing from the spirit of the invention.

I claim:

1. A shoe, comprising:

a shoe upper;

a shoe sole, attached to the shoe upper and defining an underside walking surface having a plurality of closed end bores openly extending in a predetermined arrangement inward from said surface; and a plurality of individual spike assemblies each removably secured in one of said bores and including;

a unitary housing having a hollow cylinder with a closed upper end and an open lower end and threads on an outer surface of the cylinder for threading the housing into one of said bores in the shoe sole;

a spike having an upper end and a lower end, the upper end being positioned within said housing and the lower end extending downward out of the housing to past said walking surface; and a spring within said housing for biasing the lower end of said spike downward to said extended position, while allowing the lower end of said spike to be pushed upward into a retracted position within the housing.

2. A shoe, as recited in claim 1, further comprising an apertured closure disc attached to the lower end of the cylinder for securing the spring and the upper end of said spike within the housing while permitting the lower end of said spike to extend therethrough.

3. A shoe, as recited in claim 2, wherein the disc is threadedly attached to the lower end of the cylinder at about the plane of said walking surface.

4. A shoe, as recited in claim 3, further comprising an enlarged base on the upper end of the spike slideably received within said cylinder for securing the upper end of the spike within the housing.

5. A shoe, as recited in claim 4, wherein the spring is compressed between the closed upper end of the cylinder and the base of the spike.

* * * * *